US008550798B2

(12) United States Patent
Seo et al.

(10) Patent No.: US 8,550,798 B2
(45) Date of Patent: Oct. 8, 2013

(54) INJECTION NOZZLE FOR ELECTROSPINNING AND ELECTROSPINNING DEVICE USING SAME

(75) Inventors: Inyong Seo, Seoul (KR); Byunggwang Jo, Gimpo-si (KR); Sangchul Suh, Seoul (KR); Chan Kim, Gwangju (KR); Cheolhyeon Kim, Seoul (KR); Seunghoon Lee, Goyang-si (KR); Jaehwan Kim, Uijeongbu-si (KR)

(73) Assignee: Amogreentech Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/376,399

(22) PCT Filed: Jun. 11, 2010

(86) PCT No.: PCT/KR2010/003779

§ 371 (c)(1),
(2), (4) Date: Dec. 6, 2011

(87) PCT Pub. No.: WO2010/143916

PCT Pub. Date: Dec. 16, 2010

(65) Prior Publication Data

US 2012/0088003 A1 Apr. 12, 2012

(30) Foreign Application Priority Data

Jun. 12, 2009 (KR) ..... 10-2009-0052114

(51) Int. Cl.
*D01D 5/14* (2006.01)

(52) U.S. Cl.
USPC .... 425/72.2; 425/83.1; 425/136; 425/174.8 E

(58) Field of Classification Search
USPC ..... 425/72.2, 83.1, 136, 174.8 E
See application file for complete search history.

(56) References Cited

U.S. PATENT DOCUMENTS

| | | | | |
|---|---|---|---|---|
| 4,781,560 | A * | 11/1988 | Herbert | 425/133.5 |
| 5,765,761 | A | 6/1998 | Law et al. | |
| 6,604,925 | B1 * | 8/2003 | Dubson | 425/6 |
| 7,018,188 | B2 * | 3/2006 | James et al. | 425/72.2 |
| 2001/0014358 | A1 * | 8/2001 | Fish et al. | 425/133.5 |
| 2005/0073075 | A1 | 4/2005 | Chu et al. | |
| 2006/0049542 | A1 | 3/2006 | Chu et al. | |
| 2008/0213417 | A1 | 9/2008 | Bryner et al. | |
| 2009/0093585 | A1 | 4/2009 | Smith et al. | |
| 2009/0221206 | A1 * | 9/2009 | Gerking | 442/401 |

FOREIGN PATENT DOCUMENTS

| | | | |
|---|---|---|---|
| CN | 101126179 | B | 5/2011 |
| EP | 0 495 466 | A2 | 7/1992 |
| KR | 10-2004-0032721 | A | 4/2004 |

(Continued)

*Primary Examiner* — Yogendra Gupta
*Assistant Examiner* — Joseph Leyson
(74) *Attorney, Agent, or Firm* — Dickstein Shapiro LLP

(57) ABSTRACT

The present invention relates to an injection nozzle for electrospinning including a nozzle body and an air jacket member detachably coupled with each other, and needle members coupled to the bottom surface of the node body via injection holes of the air jacket member. The electrospinning device basically performs air electrospinning for injecting a fiber solution together with air while discharging the fiber solution through the needle members, and the needle members are exposed at the ends thereof by a length long enough to carry out error-free pure electrospinning without air injection if the air jacket member is separated. Therefore, pure electrospinning or air electrospinning can be selectively carried out.

8 Claims, 4 Drawing Sheets

(56) References Cited

FOREIGN PATENT DOCUMENTS

| | | | |
|---|---|---|---|
| KR | 20-0431592 | Y1 | 11/2006 |
| KR | 10-0699315 | B1 | 3/2007 |
| KR | 10-2008-0099366 | A | 11/2008 |
| KR | 10-2008-0111849 | A | 12/2008 |
| KR | 10 0874982 | B1 | 12/2008 |

* cited by examiner

INJECTION NOZZLE FOR ELECTROSPINNING AND ELECTROSPINNING DEVICE USING SAME

TECHNICAL FIELD

The present invention relates generally to an injection node for electrospinning and an electrospinning device using the nozzle and, more particularly, to a technique invented to selectively carry out pure electrospinning or air electrospinning.

BACKGROUND ART

Generally, electrospinning is used to produce a fine diameter fiber by extruding a fiber solution charged with a voltage.

Electrospinning traces its roots to electrostatic spraying, in which a water droplet forming on the tip of a capillary tube because of the water surface tension is charged with a high voltage, so that a fine diameter filament erupts from the surface of the droplet.

Electrospinning is based on the phenomenon wherein when an electrostatic force is applied to a polymer solution or a polymer melt having a sufficiently high viscosity, the solution or the melt forms a fiber. Because the electrospinning can produce fine diameter fibers from a fiber solution, electrospinning is in recent years being used to produce nanofibers the diameters of which are on the scale of from several nanometers to several hundred nanometers.

Compared to conventional superfine fibers, nanofibers intrinsically have a high surface to volume ratio and a variety of surface and structural characteristics and, accordingly, the nanofibers are used as essential materials for high-technology industries, such as the electrical, electronic, environmental and biotechnology industries, and the application of the nanofibers is expanding to include their use as filters in the environmental industry, materials for the electrical and electronic industries, medical biomaterials, etc.

Nanofibers are typically produced using an electrospinning injection nozzle which extrudes a fiber solution using air.

The electrospinning injection nozzle includes: a solution extruding unit that is formed in a spinneret body and extrudes the fiber solution; and an air nozzle unit formed around the solution extruding unit in the spinneret body and having an air injection hole extending downwards from the periphery of the solution extruding unit, wherein the fiber solution extruded from the solution extruding unit is injected together with compressed air that has been fed downwards from the periphery of the solution extruding unit through the air injection hole.

An electrospinning device also includes a collector that collects the fiber drawn from the electrospinning injection nozzle.

In an electrospinning device, the electrospinning injection nozzle is connected to the positive pole and the collector is connected to the negative pole so that a voltage difference is created between the nozzle and the collector which renders electrospinning possible.

The electrospinning nozzle can produce nanofibers that have a diameter on the scale of from several nanometers to several hundred nanometers by injecting the fiber solution together with the compressed air.

In the conventional electrospinning nozzle, to realize effective injection, the end of the solution extruding unit is recessed into the air injection hole.

However, when the conventional electrospinning nozzle is used to carry out general electrospinning in which only the fiber solution is injected, the fiber formed by injecting the fiber solution may be caught by the air injection hole and may clog the air injection hole. Accordingly, the conventional electrospinning nozzle is problematic in that its issue is limited to producing only nanofibers with diameters ranging from several to several hundred nanometers by injecting high-compressed air.

Further, another electrospinning nozzle in which the end of the solution extruding unit protrudes outside the air injection hole has been proposed.

However, in this electrospinning nozzle, to realize error-free electrospinning, the protruding length of the solution extruding unit is limited to 1~3 mm. Due to the limited protruding length, this electrospinning nozzle cannot carry out pure electrospinning in which only the fiber solution is injected without injecting air.

In other words, in the related art, a pure electrospinning nozzle that carries out pure electrospinning by injecting only the fiber solution and an air electrospinning nozzle that carries out air electrospinning by feeding air have been separately produced and separately used.

Therefore, when the electrospinning device is used to produce a product having a variety of structural layers made of different diameter fibers using both the pure electrospinning nozzle carrying out the pure electrospinning by injecting only the fiber solution and the electrospinning node that carries out air electrospinning by feeding air, it is necessary to separately use the two types of electrospinning nozzles and this increases the facility cost and requires the nozzle to be frequently changed between the two types of electrospinning nozzles during an electrospinning process.

Furthermore, in the conventional electrospinning nozzle, an electrode is directly connected to the spinneret body and allows an electric current to flow in the fiber solution fed into the solution extruding unit, so that the magnetic field may leak from the spinneret body to the outside. Accordingly, the conventional electrospinning nozzle is problematic in that the nozzle may not carry out stable or effective electrospinning and it is required to apply a high voltage so as to compensate for the leakage of the magnetic field.

Another problem of the conventional electrospinning nozzle resides in that to realize a direct connection of the electrode, it is required to use a metal material which is a conductive material to make the nozzle, and accordingly the nozzle is heavy and the production cost thereof is increased.

DISCLOSURE

Technical Problem

Accordingly, the present invention has been made keeping in mind the above problems occurring in the prior art, and an object of the present invention is to provide an electrospinning injection nozzle and an electrospinning device using the nozzle, which can form nanofibers having fine diameters and which can selectively carry out either general electrospinning (Pure Electrospinning) in which only a fiber solution is injected or air electrospinning in which the fiber solution is injected together with high-compressed air.

Technical Solution

In order to accomplish the above object, the present invention provides an injection nozzle for electrospinning including: a nozzle body provided in a lower surface thereof with a needle locking hole and provided therein with an air passage for receiving and discharging air and with a solution feed passage communicating with the needle locking hole;

an air jacket member detachably mounted to a lower part of the nozzle body and defining an air discharge passage, spaced apart from the lower surface of the nozzle body, and having an injection hole which is in a lower part of the air jacket member and communicates with the needle locking hole and the air discharge passage; and a needle member passing through the injection hole and locked to the needle locking hole.

Furthermore, the present invention provides an electrospinning device, including:

a nozzle body provided with a needle locking hole, and provided therein with a solution feed passage communicating with the needle locking hole, and an air passage receiving and discharging air;

an air jacket member detachably mounted to a lower end of the nozzle body and defining an air discharge passage, spaced apart from a lower surface of the nozzle body, and having an injection hole which is in a lower part of the air jacket member and communicates with the needle locking hole and the air discharge passage;

a needle member passing through the injection hole and being locked to the needle locking hole;

a voltage applying unit connected to the solution feed passage of the nozzle body and storing a fiber solution therein and applying a voltage to the fiber solution stored therein;

a solution supply unit for supplying the fiber solution to the voltage applying unit;

an air supply unit for supplying air to the air passage of the nozzle body; and a collector for collecting a web of fiber injected from the needle members.

Advantageous Effects

As described above, the present invention can selectively carry out either general electrospinning (Pure Electrospinning) or air electrospinning, thereby freely controlling the spinning style according to both the nanoweb structure and the type of products.

Further, the present invention is advantageous in that different spinning styles may be selectively used in a one-line process, so that the invention can be used to produce a product in which a variety of structural layers are laminated.

Further, the present invention is advantageous in that a voltage is applied to the fiber solution, so that error-free electrospinning can be carried out using a low voltage.

BEST MODE

Figure 1:
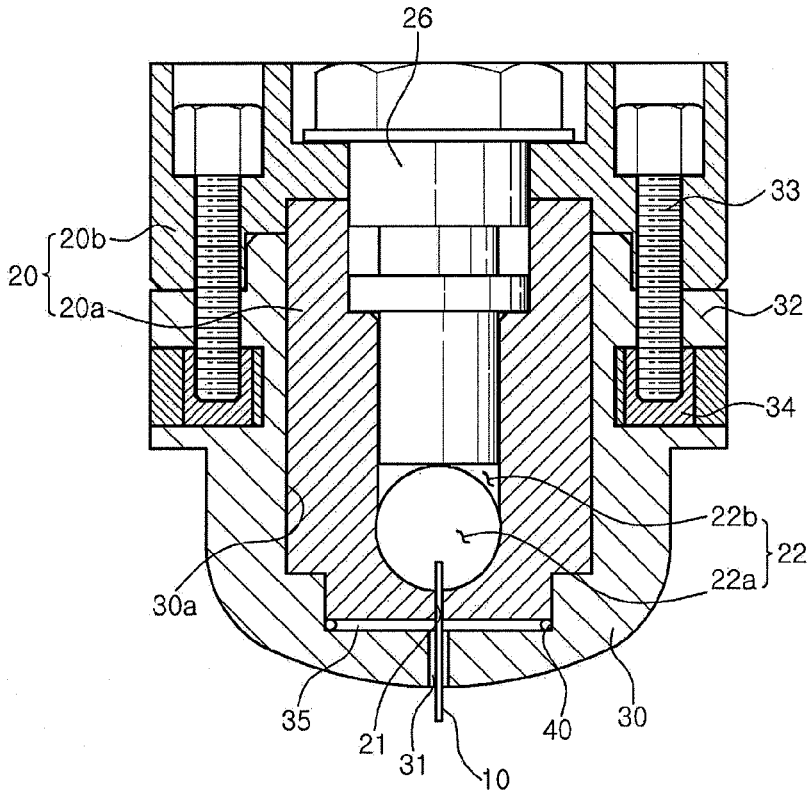
FIG. 1 and FIG. 2 are longitudinal sectional views of an electrospinning injection nozzle according to the present invention.
Figure 2:
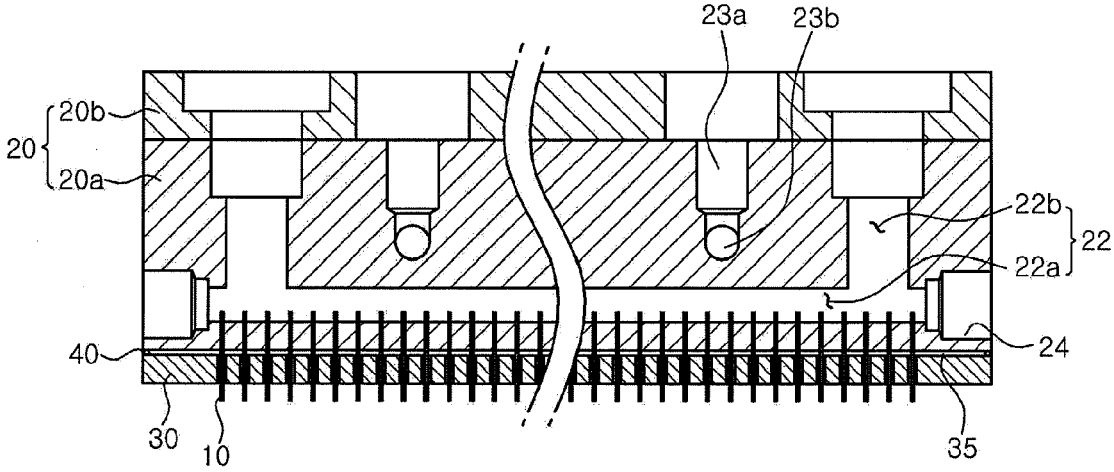

As shown in FIG. 1 and FIG. 2, a nozzle body 20 of the present invention is provided in the lower surface thereof with a needle locking hole 21 to which a needle member 10 that will be described later is locked.

To form the needle locking hole 21, a plurality of needle locking holes are formed in the lower surface of the nozzle body 20 in such a way that the holes are spaced apart from each other and a plurality of needle members 10 can be locked to the respective needle locking holes and, accordingly, it is possible to variously design the needle locking holes to suit the width of the fiber to be produced.

Further, in the nozzle body 20, a solution feed passage 22 communicating with the plurality of needle locking holes 21 is formed and an air passage 23 for receiving and discharging air is formed.

The air passage 23 discharges air through an air discharge passage formed by an air jacket member 30 which will be described later.

The air jacket member 30 is detachably mounted to the lower end of the nozzle body 20.

In the junction between the lower surface of the nozzle body 20 and the air jacket member 30, the air discharge passage 35 communicating with the air passage 23 is formed. The air discharge passage discharges air from the air passage 23.

In the air jacket member 30, injection holes 31 vertically communicating with their respective needle locking holes 21 are formed.

The injection holes 31 communicate with the air discharge passage 35 and inject air downwards from the air discharge passage 35.

In each of the needle members 10, a solution discharge hole is axially formed so that the needle members can discharge the fiber solution through the respective solution discharge holes. The needle members are locked to the plurality of needle locking holes 21, respectively.

The needle members 10 are made of a conductive material capable of realizing effective electrospinning.

Further, the needle members 10 are detachably mounted to the respective needle locking holes 21 after passing through the respective injection holes 31 of the air jacket member 30.

In the embodiment, the needle members 10 are mounted to the needle locking holes 21 by fitting. However, it is noted that the mounting of the needle members to the needle locking holes may be accomplished by a variety of methods in addition to the fitting.

Here, the needle members 10 are mounted to the respective needle locking holes 21 by fitting after passing through the respective injection holes 31 in such a way that air can pass through gaps defined outside the outer circumferential surfaces of the needle members.

Further, a block insert chamber 30*a* is defined in the air jacket member 30. Here, the top end of the block insert chamber is open.

The nozzle body 20 includes: a nozzle block 20*a*, with the needle locking holes 21 formed in the lower surface of the nozzle block and locking the respective needle members 10, and with the solution feed passage 22 defined inside the nozzle block and feeding the fiber solution to the solution discharge holes of the needle members 10 locked to the needle locking holes 21; and a cover body 20*b*, which is fitted over the upper end of the nozzle block 20*a* and is detachably mounted to the upper end of the air jacket member 30.

The nozzle block 20*a* is inserted into the block insert chamber 30*a* of the air jacket member 30, with the air discharge passage 35 defined between the nozzle block 20*a* and the air jacket member 30. The air passage 23 for discharging air to the air discharge passage 35 is formed in the nozzle block.

Further, a gap communicating with the air passage 23 is defined between the lower surface of the nozzle block 20*a* and the bottom surface of the block insert chamber 30*a*, thereby forming the air discharge passage 35.

The present invention further includes an O-ring member 40 which seals the periphery of the injection holes 31 and thereby seals the air discharge passage 35 in the junction between the lower surface of the nozzle block 20*a* and the bottom surface of the block insert chamber 30*a*.

The nozzle body 20 includes the nozzle block 20*a*, to which the needle members 10 are locked by fitting, and the cover body 20*b* which is mounted to the nozzle block 20*a* and is detachably mounted to the air jacket member 30, so that the nozzle block 20*a* and the cover body 20*b* may be made of different materials.

In other words, the nozzle block 20*a* may be made of Teflon which allows the needle members 10 to be locked to the respective needle locking holes 21 by fitting.

Further, the cover body 20*b* or the air jacket member 30 may be made of PEEK (Poly ether ether ketone), acetal (POM; Polyoxymethylene) or MC nylon (Mono Cast Nylon).

The PEEK (Poly ether ether ketone), acetal (POM; Polyoxymethylene) and MC nylon (Mono Cast Nylon) are excellent in terms of mechanical performance, such as heat resistance, chemical resistance and durability, so that it is possible to realize the desired strength of the cover body 20*b* or of the air jacket member 30 which are mounted in an assembled state.

The air passage 23 of the nozzle block 20*a* includes: a first air passage 23*b* which is vertically formed through the opposite side parts of the nozzle block 20*a* and in which the opposite open ends of the first air passage are closed by second plugs;

a main air passage 23*a* which is formed through the nozzle block 20*a* upwards from the center of the first air passage 23*b*; and a second air passage 23*c* which is formed in the lower part of the nozzle block 20*a* such that the second air passage communicates with the lower ends of the opposite parts of the first air passage 23*b* divided from the main air passage 23*a* and feeds air into the air discharge passage 35.

Further, the main air passage 23*a* communicates with a second pipe coupling 27, which is fitted into the cover body 20*b* and is connected to the air supply unit 70, so that the main air passage receives high-compressed air.

Here, both a first pipe coupling 26 for feeding the fiber solution to the solution feed passage 22 and the second pipe coupling 27 for feeding air to the air passage 23 are fitted into the cover body 20*b*.

The nozzle block 20*a* and the cover body 20*b* are provided with a bolt unit which is locked upwards to the nozzle block 20*a* in the end of the first pipe coupling 26 or of the second pipe coupling 27, so that the nozzle block 20*a* and the cover body 20*b* are integrated into a single body by the bolt unit.

Further, in the opposite side surfaces of the air jacket member 30, respective mounting parts 32 are formed in lengthwise directions by protruding outwards and are detachably mounted to the lower surface of the cover body 20*b*.

Here, the cover body 20*b* and the air jacket member 30 are detachably assembled with each other by bolt members 33, which pass through the cover body 20*b* and are tightened to respective nuts 34 inserted into the mounting parts 32.

Further, the solution feed passage 22 of the nozzle block 20*a* includes a main feed passage 22*a*, which is axially formed through the nozzle block and communicates with the needle locking holes 21 and in which the opposite open ends thereof are closed by first plugs 24, and a vertical feed passage 22*b* which vertically extends from the main feed passage 22*a* to the upper surface of the nozzle block 20*a*.

The vertical feed passage 22*b* communicates with the first pipe coupling 26 that is fitted into the cover body 20*b*.

Figure 3:
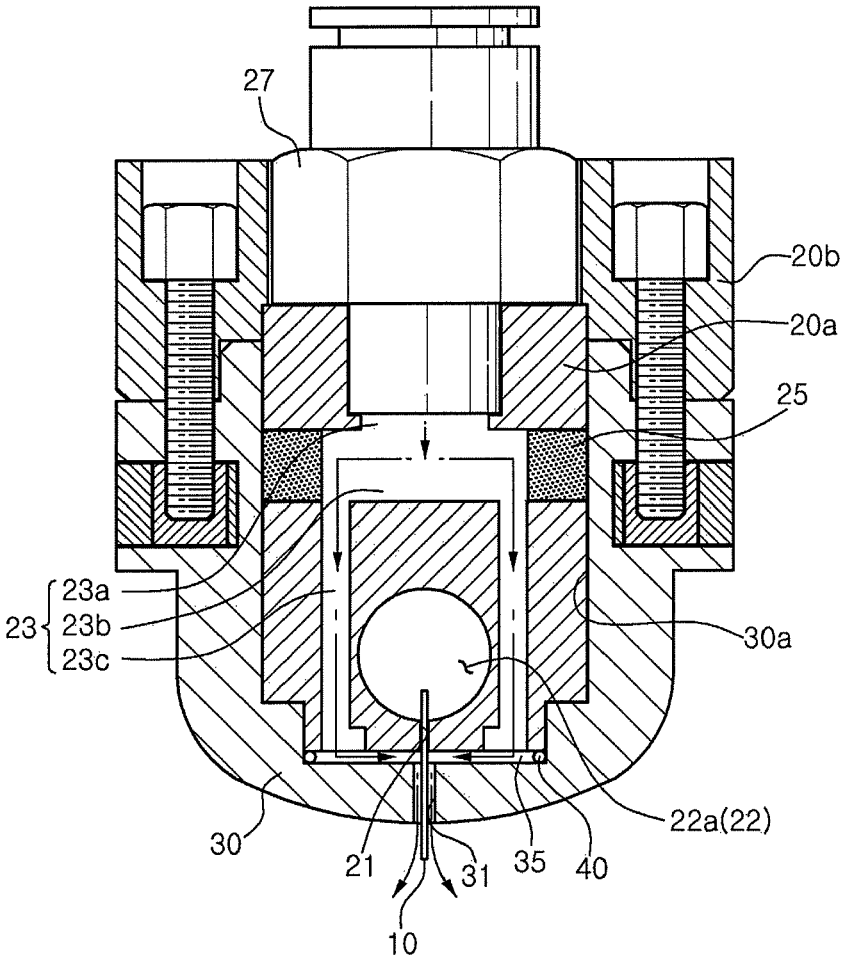
FIG. 3 is a cross sectional view of the electrospinning injection nozzle according to the present invention.

Further, as shown in FIG. 3, the plurality of needle members 10 may be mounted in such a way that they pass through the respective needle locking holes 21 and the upper ends thereof protrude into the solution feed passage 22 or into the main feed passage 22*a* to a predetermined length.

Here, the needle members 10 are fitted into the needle locking holes 21 by using a needle fitting jig (not shown) capable of holding the needle members 10 in such a way that the upper ends of the needle members protrude into the main feed passage 22*a* to the predetermined length.

When the needle fitting jig is used to mount the needle members 10 by fitting, the holding part of the jig that holds the needle members 10 is caught by the lower part of the air jacket member 30 and the upper ends of the needle members 10 protrude into the main feed passage 22*a* to the predetermined length.

Here, the protruding length of the needle members 10 may be changed depending on the viscosity of the fiber solution and, in the present invention, the protruding length of the needle members may be set to 3~5 mm or less.

When the needle members 10 unevenly protrude into the solution feed passage 22, the fiber solution fed through the vertical feed passage 22*b* is sequentially injected through the needle members 10 in order of the protruding lengths, from short to long.

Therefore, a deviation may undesirably remain in the fiber layer which has been electrospun from the plurality of needle members 10 and collected on the collector.

When the upper ends of the needle members 10 are mounted in such a way that the upper ends are leveled with the bottom surface of the solution feed passage 22, the fiber solution is fed to the needle members 10 in order of the extent by which the upper ends of the needle members approach the bottom surface of the vertical feed passage 22*b*, so that the fiber solution cannot be synchronously electrospun from the plurality of needle members 10, but is differentially electrospun and is differentially collected, and thereby a deviation remains in the collected fiber layer.

However, when the fiber solution is fed into the solution feed passage 22 in a state in which the upper ends of the needle members 10 protrude into the solution feed passage 22 to a predetermined height, the fiber solution gradually fills the solution feed passage 22 from the bottom surface of the solution feed passage 22 and is, thereafter, synchronously introduced into the plurality of needle members 10 at the height of the upper ends of the needle members 10 protruding from the bottom surface of the solution feed passage 22.

Therefore, the fiber solution is synchronously injected and electrospun from the plurality of needle members 10, so that there is no deviation in the electrospun and the collected fiber layer.

To realize error-free air electrospinning from the needle members 10 in a state in which the air jacket member 30 is mounted to the nozzle body 20, the needle members 10 may be recessed into the injection holes 31 of the air jacket member 30.

Alternatively, the needle members 10 may be arranged in such a way that they protrude downwards from the lower end of the air jacket member 30 to a predetermined length of 1~4 mm.

Described in detail, in the electrospinning injection nozzle according to the present invention in which the air jacket member 30 is mounted to the nozzle body 20, the fiber solution is fed into the needle members 10 through the solution feed passage 22 and is injected therefrom, and high-compressed air is fed into the injection holes 31 through the air passage 23, so that the air electrospinning in which the fiber solution is injected together with air can be realized.

Air electrospinning can produce nanofibers having fine diameters.

Figure 4:
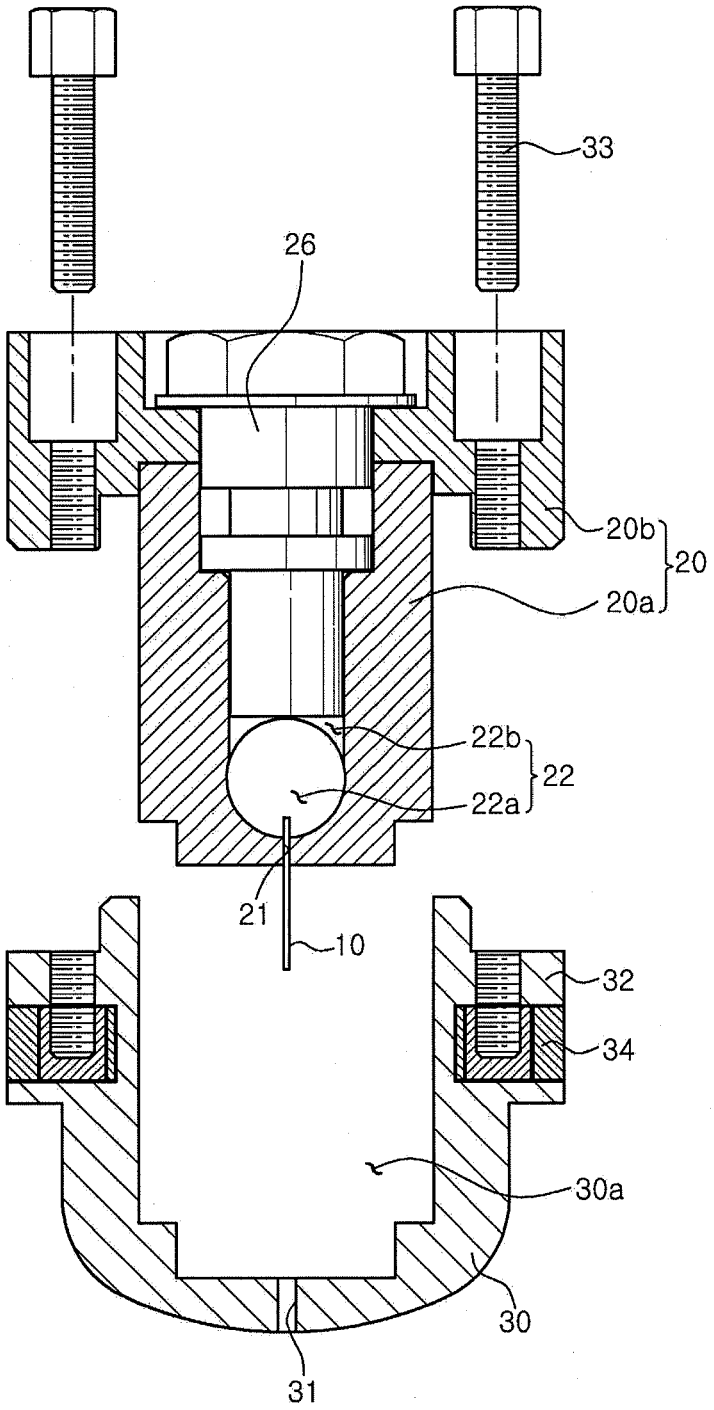
FIG. 4 is a sectional view illustrating the operation of an embodiment of the electrospinning injection nozzle according to the present invention.

Further, when the air jacket member 30 is separated from the nozzle body 20 in the electrospinning injection nozzle of the present invention, as shown in FIG. 4, the needle members 10 can be exposed by a length capable of realizing error-free general electrospinning in which the needle members inject only the fiber solution without injecting air.

Accordingly, by separating the air jacket member 30 from the nozzle body, the electrospinning injection nozzle of the present invention can stably carry out general electrospinning in which only the fiber solution is injected from the needle members 10 without injecting air.

Figure 5:
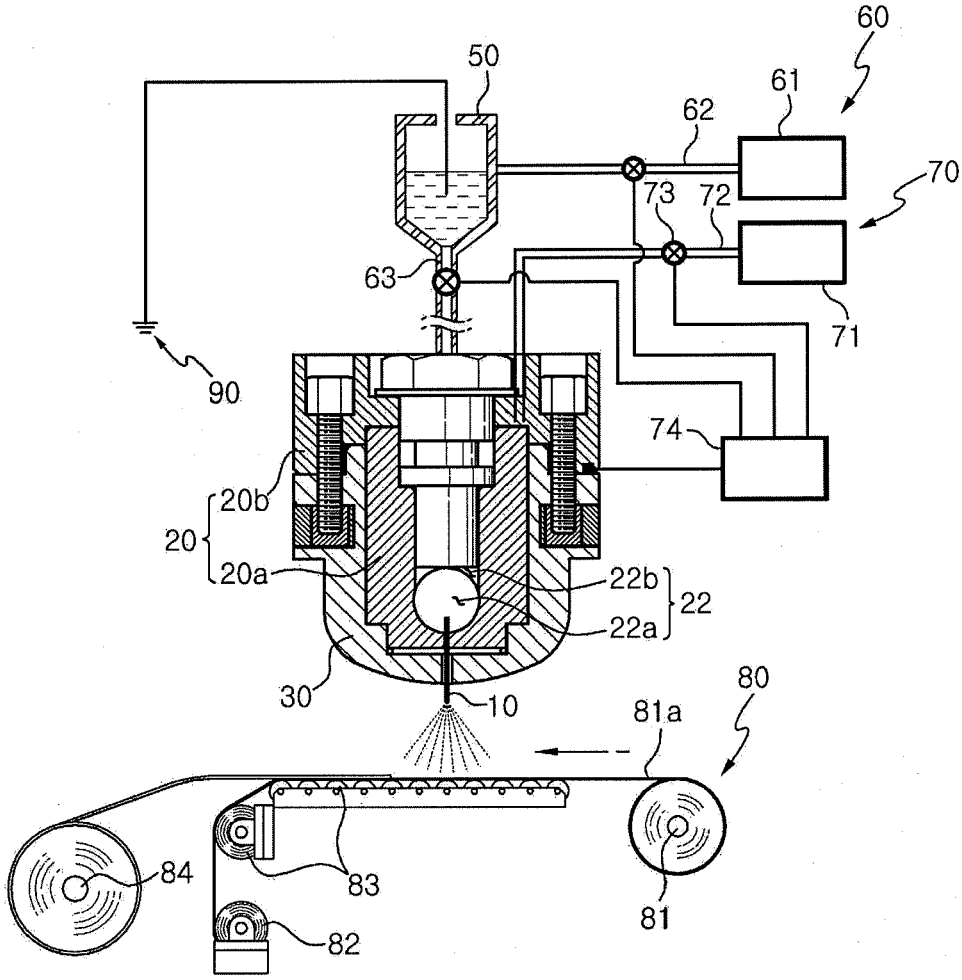
FIG. 5 is a schematic view illustrating an electrospinning device according to the present invention.

Further, as shown in FIG. 5, an electrospinning device using the electrospinning nozzle of the present invention includes: the nozzle body 20 having the needle locking holes 21 in the lower surface thereof, with the solution feed passage 22 communicating with the needle to locking holes 21 and the air passage 23 receiving and discharging air;

the air jacket member 30 detachably mounted to the lower end of the nozzle body 20, with the air discharge passage 35, spaced apart from the lower surface of the nozzle body 20, and with the injection holes 31 communicating with both the needle locking holes 21 and the air discharge passage 35;

the needle members 10 passing through the injection holes 31 and being locked to the needle locking holes in the lower part of the air jacket member;

a voltage applying unit 50 connected to the solution feed passage 22 of the nozzle body 20 and temporarily storing the fiber solution therein and applying a voltage to the fiber solution stored therein;

a solution supply unit 60 for supplying the fiber solution to the voltage applying unit 50;

the air supply unit 70 for supplying air to the air passage 23 of the nozzle body 20; and a collector 80 for collecting a web of fiber spun from the needle members 10.

The electrospinning device of the present invention further includes a voltage supply unit 90, in which one electrode for applying a voltage is connected to the fiber solution stored in the voltage applying unit 50 and the other electrode is grounded, so that a voltage difference can be generated.

The solution supply unit 60 includes a solution storage tank 61 for storing the fiber solution, a first hose 62 extending from the solution storage tank 61 to the voltage applying unit 50 and a second hose 63 extending from the voltage applying unit 50 to the solution feed passage 22. The solution supply unit 60 feeds the fiber solution to the first air passage 23*b* through the voltage applying unit 50.

Further, it is preferred that a flow control valve for controlling the amount of supplied fiber solution be mounted to the first hose 62 or to the second hose 63, thereby controlling the amount of fiber solution supplied to the solution feed passage 22.

The second hose 63 is connected to the first pipe coupling 26 that is mounted to the solution feed passage 22 in the upper surface of the nozzle body 20. The second hose 63 feeds the fiber solution, in which an electric current flows, to the solution feed passage 22.

As described above, in the electrospinning device of the present invention, the fiber solution fed from the solution storage tank 61 is temporarily stored in the voltage applying unit 50 and a voltage is applied to the stored fiber solution.

In the voltage supply unit 90, one electrode is connected to the fiber solution stored in the voltage applying unit 50 and the other electrode is grounded so that a voltage difference capable of realizing electrospinning can be generated between the needle members 10 and the collector 80 that collects the web of fiber electrospun from needle members 10.

The collector 80 includes: a first reel 81, around which a fiber collecting sheet 81*a*, such as a vellum paper sheet, a nonwoven fabric sheet or a film sheet, for collecting the electrospun fiber is wound;

a second reel 82, which is placed at a location spaced apart from the first reel 81 and to which the end of the fiber collecting sheet 81*a* wound around the first reel 81 is connected and which takes up the web of electrospun fiber;

a plurality of guide rolls 83 placed between the first reel 81 and the second reel 82 in such a way that the guide rolls are spaced apart from each other by predetermined distances and guiding the movement of the fiber collecting sheet 81*a* fed from the first reel 81 to the second reel 82; and a third reel 84 placed at a location near the second reel 82 and rotated by a motor and taking up the electrospun fiber collected on the fiber collecting sheet 81*a*.

In the present invention, the electrospinning is realized by the application of voltage to the fiber solution, so that the present invention can prevent the electrospinning from being variable or inefficient as may result if the magnetic field leaks to the outside of both the nozzle body 20 and the air jacket member 30, and, furthermore, can realize error-free electrospinning even when the voltage difference between the needle members and the collector 80 is small.

Further, the fiber electrospun from the needle members 10 is collected in the form of a web on the surface of the fiber collecting sheet 81*a* and is moved together with the fiber collecting sheet 81*a*, and is taken up around the third reel 84.

Here, the fiber collecting sheet 81*a* taken up by the second reel 82 may be removed from the second reel and may be installed on the first reel 81 so as to be reused.

Further, the air jacket member 30 can be assembled with or removed from the nozzle body 20 so that the present invention can selectively carry out general electrospinning (pure electrospinning) or air electrospinning.

Further, the nozzle body 20, the air jacket member 30 and the needle members 10 included in the electrospinning device of the present invention remain the same as those described in the above description, so that the further explanation of the elements is omitted to avoid repeated explanation.

The air supply unit 70 includes: an air storage tank 71 storing air therein;

an air feed pipe 72 extending from the air storage tank 71 to the first air passage 23*b;* an air control valve 73 mounted to the air feed pipe 72 and opening or closing the air feed pipe 72;

a sensor 74 provided in the junction between the nozzle body 20 and the air jacket member 30 and sensing the locked or separated state of the air jacket member 30; and a valve control unit 75 cooperating both with the sensor 74 and with the air control valve 73 and opening or closing the air control valve 73 in response to a signal output from the sensor 74.

The valve control unit 75 also cooperates with the flow control valves of both the first hose 62 and with the second hose 63, thereby opening or closing the flow control valves and thereby controlling the opening ratios of the flow control valves.

Further, the sensor 74 uses a contact sensor, which is mounted to the lower surface of the nozzle body 20 that is the lower surface of the cover body 20*b* in such a way that the sensor comes into contact with the upper surface of the air jacket member 30.

The sensor 74 basically functions to sense the locked or separated state of the air jacket member 30 relative to the lower surface of the nozzle body 20 and the sensor 74 may be variously modified using conventional sensors.

When a signal indicative of a separated state of the air jacket member 30 is output from the sensor 74 to the valve control unit 75, the air control valve 73 closes the air feed pipe 72.

Accordingly, when the air jacket member 30 is separated from the nozzle body 20, air is not fed to the needle members 10, but only the fiber solution is injected from the needle members 10, so that pure electrospinning can be carried out.

However, when the air jacket member 30 is locked to the nozzle body, the sensor 74 senses the locked state of the air jacket member and outputs a signal indicative of the locked state to the valve control unit 75.

In response to the input signal, the valve control unit 75 actuates the air control valve 73 and opens the air feed pipe 72.

Therefore, when the air jacket member 30 is locked to the nozzle body 20, air or hot air is fed to the needle members 10 so that the needle members inject the fiber solution together with the air or hot air, thereby carrying out air electrospinning or hot air electrospinning.

The electrospinning device of the present invention can control the supply of air by automatically sensing the locked or separated state of the air jacket member 30, so that the present invention can selectively carry out error-free pure electrospinning or air electrospinning without having to additionally control the supply of air.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An injection nozzle for electrospinning, comprising:

a nozzle body provided in a lower surface thereof with a needle locking hole and provided therein with an air passage for receiving and discharging air and with a solution feed passage communicating with the needle locking hole;

an air jacket member detachably mounted to a lower part of the nozzle body and defining an air discharge passage, spaced apart from the lower surface of the nozzle body, and having an injection hole which is in a lower part of the air jacket member and communicates with the needle locking hole and the air discharge passage; and a needle member passing through the injection hole and being locked to the needle locking hole, wherein the nozzle body includes:

a nozzle block, with the needle locking hole formed in a lower surface of the nozzle block and locking the needle member, and with the solution feed passage defined inside the nozzle block and feeding a fiber solution to a solution discharge hole of the needle member locked to the needle locking hole; and a cover body mounted to an upper end of the nozzle block and detachably mounted to an upper end of the air jacket member, wherein the nozzle block is inserted into a block insert chamber of the air jacket member, the nozzle block having the air discharge passage defined between the nozzle block and the air jacket member, and having therein the air passage for discharging air to the air discharge passage.

2. The injection nozzle for electrospinning as set forth in claim 1, wherein the needle member is locked into the needle locking hole by fitting.

3. The injection nozzle for electrospinning as set forth in claim 1, further comprising:

an O-ring member placed between the lower surface of the nozzle block and a bottom surface of the block insert chamber and sealing the air discharge passage.

4. The injection nozzle for electrospinning as set forth in claim 1, wherein the air passage of the nozzle block includes: a first air passage which is formed through opposite side parts of the nozzle block and in which opposite open ends of the first air passage are closed by second plugs;

a main air passage formed through the nozzle block upwards from a center of the first air passage; and a second air passage which is formed in a lower part of the nozzle block in such a way that the second air passage communicates with lower ends of opposite parts of the first air passage divided from the main air passage and feeds air into the air discharge passage.

5. The injection nozzle for electrospinning as set forth in claim 1, wherein the nozzle body is provided therein with a plurality of needle locking holes spaced apart from each other, the solution feed passage includes a main feed passage communicating with the plurality of needle locking holes, and the plurality of needle members are locked to the respective needle locking holes in such a way that ends of the needle members protrude into the main feed passage to a predetermined length.

6. The injection nozzle for electrospinning as set forth in claim 1, wherein a sensor is placed between the nozzle body and the air jacket member and senses a separated or locked state of the air jacket member.

7. An electrospinning device, comprising:

a nozzle body provided with a needle locking hole, and provided therein with a solution feed passage communicating with the needle locking hole, and an air passage receiving and discharging air;

an air jacket member detachably mounted to a lower end of the nozzle body and defining an air discharge passage, spaced apart from a lower surface of the nozzle body, and having an injection hole which is in a lower part of the air jacket member and communicates with the needle locking hole and the air discharge passage;

a needle member passing through the injection hole and being locked to the needle locking hole;

a voltage applying unit connected to the solution feed passage of the nozzle body and storing a fiber solution therein and applying a voltage to the fiber solution stored therein;

a solution supply unit for supplying the fiber solution to the voltage applying unit;

an air supply unit for supplying air to the air passage of the nozzle body; and a collector for collecting a web of fiber injected from the needle members, wherein the nozzle body includes:

a nozzle block, with the needle locking hole formed in a lower surface of the nozzle block and locking the needle member, and with the solution feed passage defined inside the nozzle block and feeding a fiber solution to a solution discharge hole of the needle member locked to the needle locking hole; and a cover body mounted to an upper end of the nozzle block and detachably mounted to an upper end of the air jacket member, wherein the nozzle block is inserted into a block insert chamber of the air jacket member, the nozzle block having the air discharge passage defined between the nozzle block and the air jacket member, and having therein the air passage for discharging air to the air discharge passage.

8. The electrospinning device as set forth in claim 7, wherein the air supply unit includes: an air storage tank storing air therein;

an air feed pipe extending from the air storage tank to a first air passage;

an air control valve mounted to the air feed pipe and opening or closing the air feed pipe;

a sensor provided in a junction between the nozzle body and the air jacket member and sensing a locked or separated state of the air jacket member; and a valve control unit cooperating both with the sensor and with the air control valve and opening or closing the air control valve in response to a signal output from the sensor.

* * * * *